US010692320B2

(12) United States Patent
Yuasa et al.

(10) Patent No.: US 10,692,320 B2
(45) Date of Patent: Jun. 23, 2020

(54) CASH PROCESSING DEVICE AND SERVER

(71) Applicant: Oki Electric Industry Co., Ltd., Tokyo (JP)

(72) Inventors: Shuichi Yuasa, Tokyo (JP); Kiyoshi Yamanaka, Tokyo (JP)

(73) Assignee: Oki Electric Industry Co., Ltd., Tokyo (JP)

( * ) Notice: Subject to any disclaimer, the term of this patent is extended or adjusted under 35 U.S.C. 154(b) by 44 days.

(21) Appl. No.: 15/777,094

(22) PCT Filed: Oct. 14, 2016

(86) PCT No.: PCT/JP2016/080600
§ 371 (c)(1),
(2) Date: May 17, 2018

(87) PCT Pub. No.: WO2017/104247
PCT Pub. Date: Jun. 22, 2017

(65) Prior Publication Data

US 2018/0330563 A1 Nov. 15, 2018

(30) Foreign Application Priority Data

Dec. 14, 2015 (JP) ..... 2015-243296

(51) Int. Cl.

| | |
|---|---|
| ***G07D 11/13*** | (2019.01) |
| ***G07D 11/16*** | (2019.01) |
| ***G07D 11/23*** | (2019.01) |
| ***G07D 11/24*** | (2019.01) |
| ***G07D 11/34*** | (2019.01) |

(Continued)

(52) U.S. Cl.
CPC ..... *G07D 11/23* (2019.01); *G07D 11/13* (2019.01); *G07D 11/16* (2019.01); *G07D 11/24* (2019.01); *G07D 11/245* (2019.01); *G07D 11/34* (2019.01); *G07D 11/60* (2019.01); *G07F 19/20* (2013.01); *G07D 7/181* (2017.05); *G07D 11/14* (2019.01);
(Continued)

(58) Field of Classification Search
CPC ..... G07D 11/13; G07D 11/16; G07D 11/23; G07D 11/24; G07D 11/34; G07F 19/20
USPC ..... 235/379
See application file for complete search history.

(56) References Cited

U.S. PATENT DOCUMENTS

2002/0082994 A1* 6/2002 Herziger ..... G06Q 10/06 705/43
2014/0238815 A1* 8/2014 Iwamura ..... G07F 7/04 194/206

(Continued)

FOREIGN PATENT DOCUMENTS

JP H06-144696 A 5/1994
JP H11-025352 A 1/1999
JP 2000-339516 A 12/2000

*Primary Examiner* — Toan C Ly
(74) *Attorney, Agent, or Firm* — Rabin & Berdo, P.C.

(57) ABSTRACT

A cash processing device according to the present invention includes plural banknote storage sections, a storage status manager, and a display controller. The plural banknote storage sections store banknotes. The storage status manager manages a storage status in each of the banknote storage sections. According to the storage status in each of the banknote storage sections, the display controller displays a display screen to suppress a specific transaction from out of plural transaction types and/or to encourage a transaction other than the specific transaction from out of the plural transaction types.

6 Claims, 15 Drawing Sheets

(51) Int. Cl.

| | |
|---|---|
| ***G07F 19/00*** | (2006.01) |
| ***G07D 11/245*** | (2019.01) |
| ***G07D 11/60*** | (2019.01) |
| *G07D 11/14* | (2019.01) |
| *G07D 7/181* | (2016.01) |

(52) U.S. Cl.
CPC ..... *G07D 2207/00* (2013.01); *G07D 2211/00* (2013.01)

(56) References Cited

U.S. PATENT DOCUMENTS

| | | | | |
|---|---|---|---|---|
| 2016/0335830 | A1* | 11/2016 | Wakabayashi | B65H 29/60 |
| 2017/0003857 | A1* | 1/2017 | Mande | H04L 67/306 |

* cited by examiner

FIG.9

| CASH PROCESSING DEVICE NO. | | | | | | | |
|---|---|---|---|---|---|---|---|
| 01 | 02 | 03 | 04 | 05 | 06 | 07 | 08 |
| (PAY-IN) CUSTOMER GUIDANCE THRESHOLD EXCEEDED | NORMAL | NORMAL | NORMAL | NORMAL | NORMAL | NORMAL | NORMAL |
| DISPLAY TO SUPPRESS PAY-IN | DO NOT DISPLAY | DO NOT DISPLAY | DO NOT DISPLAY | DO NOT DISPLAY | DO NOT DISPLAY | DO NOT DISPLAY | DO NOT DISPLAY |
| BRANCH GP1 | | | | BRANCH GP2 | | | |

FIG.12

| No. | PAY-IN TRANSACTIONS | PAY-OUT TRANSACTIONS |
|---|---|---|
| 1 | AVAILABLE | AVAILABLE |
| 2 | AVAILABLE | LIMITED |
| 3 | LIMITED | AVAILABLE |
| 4 | AVAILABLE | AVAILABLE |

FIG.13

| No. | PAY-IN TRANSACTIONS | PAY-OUT TRANSACTIONS |
|---|---|---|
| 1 | ○ | ○ |
| 2 | ○ | △ |
| 3 | △ | ○ |
| 4 | ○ | ○ |

CASH PROCESSING DEVICE AND SERVER

TECHNICAL FIELD

The present invention relates to a cash processing device and a server, for example a cash processing device and a server installed in a financial institution or the like.

BACKGROUND ART

Branches of financial institutions and the like use cash processing devices, typified by Automatic Teller Machines (ATMs), for example.

Cash processing devices are loaded with banknote cassettes in which banknotes are stored by denomination. In a pay-in transaction, inserted banknotes are stored in the banknote cassettes. In a pay-out transaction, banknotes stored in the banknote cassettes are fed out.

If, for example, a cassette-full sensor provided in a banknote cassette detects a full state, an alarm is used to notify a secure courier company or the like to collect the banknotes from the banknote cassette. An employee is called out to the financial institution or the like, and the employee collects banknotes from the banknote cassette. In another example, if a cassette-empty sensor in a banknote cassette detects an empty state, similarly, an alarm is used to notify the secure courier company or the like to load banknotes into the banknote cassette, and an employee will load banknotes into the banknote cassette.

Japanese Patent Application Laid-Open (JP-A) No. 2000-339516 and JP-A No. H11-25352 disclose cash processing devices that disable pay-in transactions or pay-out transactions when the cash processing device is in a full state or an empty state, and that guide a customer to another cash processing device.

SUMMARY OF INVENTION

Technical Problem

In cases in which, for example, plural cash processing devices are present in a branch of a financial institution or the like, an employee of a secure courier company is called out to collect banknotes or load banknotes when any of the cash processing devices has reached a full state or an empty state.

In the branch itself, transactions tend to be focused on certain cash processing devices due to factors such as the locations or models of the cash processing devices. For example, cash processing devices close to the store entrance tend to be heavily used, while cash processing devices positioned further from the entrance may be lightly used.

For this reason, an employee may be called out when only a certain cash processing device on which transactions are focused is in a full state or an empty state, despite the fact that other cash processing devices are capable of performing transactions. This may result in the issue of a needlessly large number of employee callouts.

Accordingly, in order to even out the overall usage of plural cash processing devices and reduce the frequency of employee callouts, there is demand for cash processing devices and cash processing systems capable of indicating a temporary suppression of pay-in transactions or pay-out transactions prior to reaching a full state or an empty state, and capable of guiding customers to another cash processing device.

Solution to Problem

In order to address this issue, a cash processing device according to a first present invention includes: (1) plural banknote storage sections that store banknotes; (2) a storage status manager that manages a storage status in each of the banknote storage sections; and (3) a display controller that, according to the storage status in each of the banknote storage sections, displays a display screen to suppress a specific transaction from out of plural transaction types and/or to encourage a transaction other than the specific transaction from out of the plural transaction types.

A server according to a second present invention is a server that manages storage statuses for each of plural cash processing devices respectively including plural banknote storage sections. The server includes: (1) a storage status manager that manages a storage status acquired from the respective cash processing devices for each of the banknote storage sections; and (2) a display controller that, according to the storage status in each of the banknote storage sections of the cash processing devices, displays a display screen to suppress a specific transaction from out of plural transaction types or to encourage a transaction other than the specific transaction from out of the plural transaction types.

Advantageous Effects of Invention

The present invention is capable of indicating a temporary suppression of pay-in transactions or pay-out transactions and capable of guiding customers to another cash processing device before a full state or an empty state is reached so as to even out overall usage of plural cash processing devices, and reduce the frequency of employee callouts.

BRIEF DESCRIPTION OF DRAWINGS

FIG. 9 is an explanatory diagram to explain management information in a server according to a second exemplary embodiment.

FIG. 12 is an explanatory diagram to explain customer guidance display screens displayed on a third display section according to the first exemplary embodiment.

FIG. 13 is an explanatory diagram to explain customer guidance display screens displayed on a third display section according to the first exemplary embodiment.

DESCRIPTION OF EMBODIMENTS

(A) First Exemplary Embodiment

Detailed explanation follows regarding a first exemplary embodiment of a cash processing device and server according to the present invention, with reference to the drawings.

The first exemplary embodiment describes an example in which the present invention is applied to cash processing devices, such as ATMs provided in a financial institution or the like, and a server that monitors the cash processing devices.

(A-1) First Exemplary Embodiment: Configuration

Figure 1:
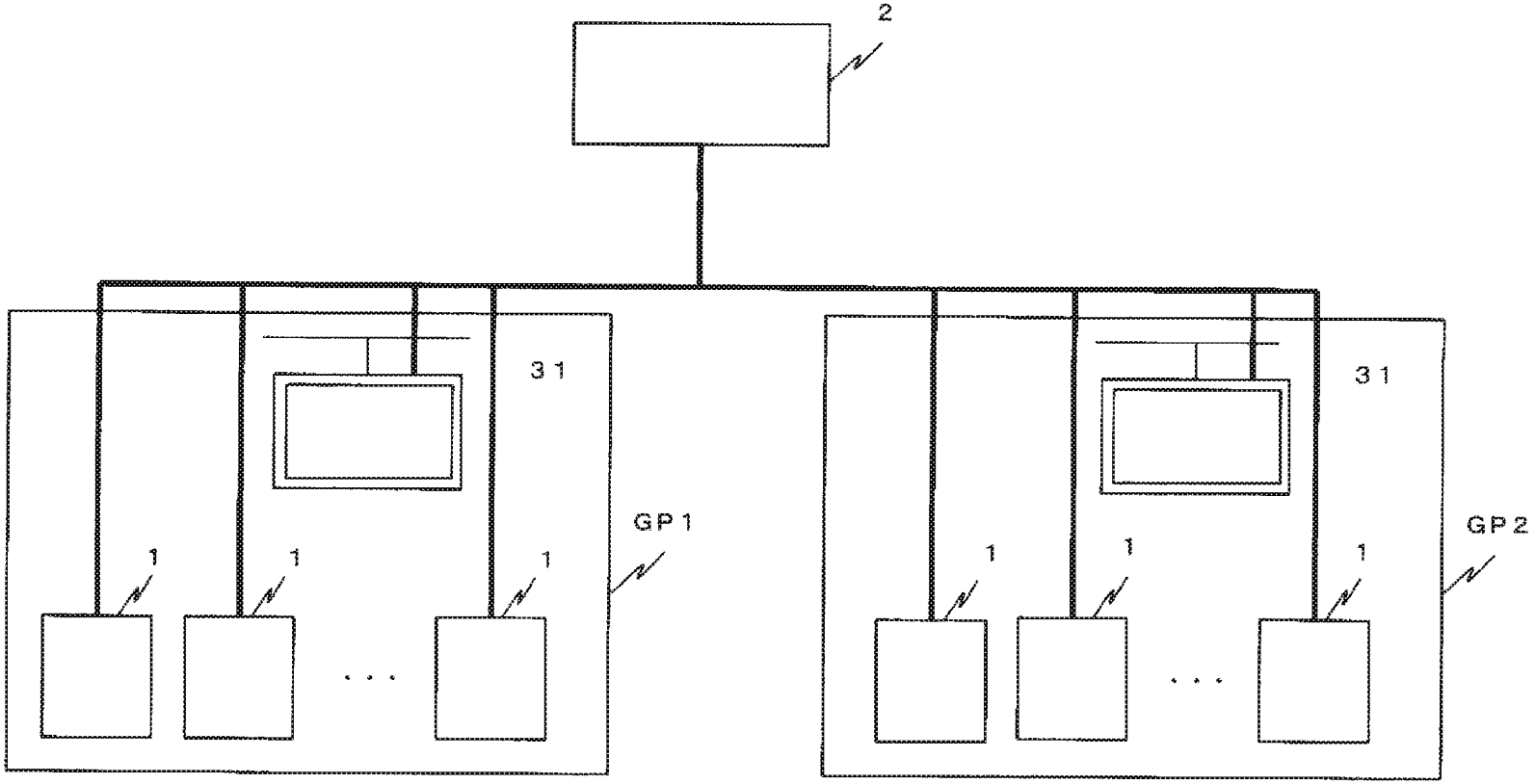
FIG. 1 is an overall configuration diagram illustrating an overall configuration of a cash processing system according to a first exemplary embodiment.

FIG. 1 is an overall configuration diagram illustrating an overall configuration of a cash processing system according to the first exemplary embodiment.

A cash processing system 9 according to the first exemplary embodiment illustrated in FIG. 1 includes a server 2 and plural cash processing devices 1.

In the example illustrated in FIG. 1, plural cash processing devices 1 are installed in respective branches GP1, GP2 of a financial institution. The cash processing system 9 is capable of exchanging information between the server 2 and each cash processing device 1 in each of the branches GP1, GP2.

An electronic information board 31 that informs customers of the state of each cash processing device 1 is installed in each of the branches GP1, GP2 in the vicinity of the location where the plural cash processing devices 1 are installed. In the present exemplary embodiment, for ease of explanation, only the two branches GP1, GP2 are illustrated. However, the number of branches managed by the server 2 is not limited thereto.

The third display section 31 displays the states of all of the plural cash processing devices 1, and a liquid crystal display, a segment display, or an electronic information board or the like may be employed therefor. The third display section 31 is connected to the server 2, and displays information received from the server 2. The placement position of the third display section 31 is not particularly limited, and is preferably a position clearly visible to customers using the cash processing devices 1. For example, the third display section 31 may be suspended from the ceiling or mounted to a wall in the area where the cash processing devices 1 are installed.

Each of the cash processing devices 1 is a cash processing device installed in the branch GP1 or the branch GP2 of the financial institution. For example, ATMs that perform pay-in transactions, pay-out transaction, and the like may be applied as the cash processing devices 1. Pay-in-only devices that only perform cash pay-in transactions, pay-out-only devices that only perform cash pay-out transactions, or pay-in/pay-out devices that perform both cash pay-in transactions and cash pay-out transactions may also be applied as the cash processing devices 1.

The server 2 acquires various information from the cash processing devices 1 installed in the branches GP1, GP2 of the financial institution, and manages information relating to the cash processing devices 2 based on this acquired information. In the present exemplary embodiment, the server 2 is capable of displaying the transaction types that can be handled by each cash processing device 1 on the third display sections 31 and on second display sections 32, according to the number of stored notes stored in the banknote cassettes of each cash processing device 1. This enables customers to be guided to a cash processing device capable of handling the customer's desired transaction.

Figure 2:
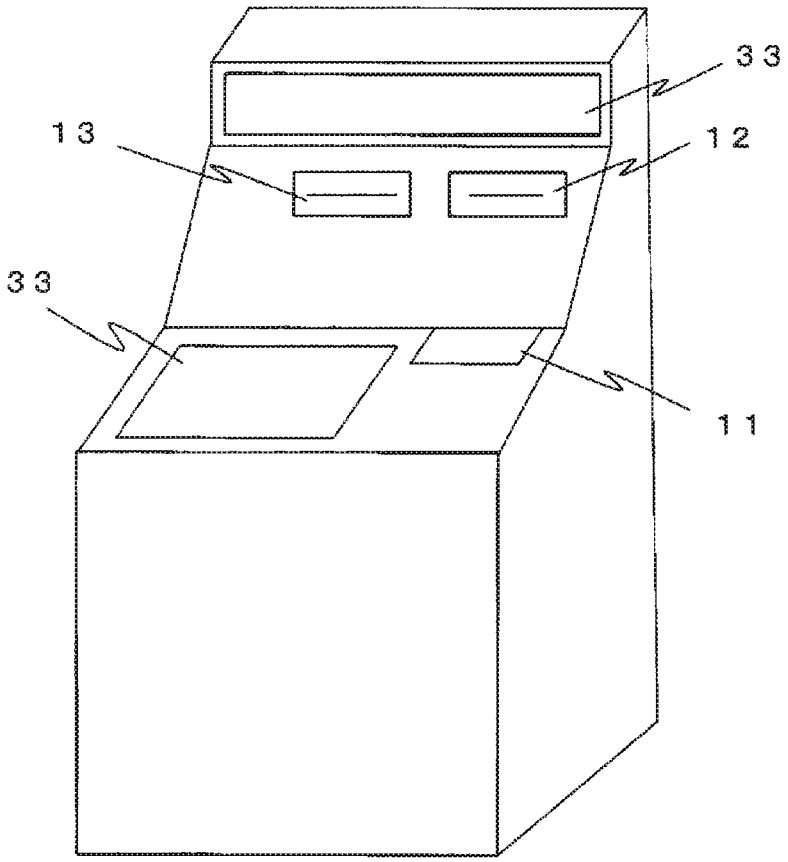
FIG. 2 is a perspective view illustrating main parts of an external configuration of a cash processing device according to the first exemplary embodiment.

FIG. 2 is a perspective view illustrating main parts of the external configuration of a cash processing device 1 according to the first exemplary embodiment.

As illustrated in FIG. 2, each cash processing device 1 includes a banknote pay-in/pay-out port 11, a card insertion/removal port 12, a passbook insertion/removal port 13, an operation and display section 33, and the second display section 32.

A physically integrated operation section and display section such as a touch panel display may be applied as the operation and display section 33. Alternatively, the operation and display section 33 may be configured such that an operation section configured by operation buttons or the like is physically distinct to a display section such as a display. The operation and display section 33 is primarily used as an operation section and a display section that a customer uses to perform transaction operations when the customer performs transactions of various types. Namely, the operation and display section 33 displays transaction type menu screens, displays various transaction input screens to proceed with various transactions selected by the customer, and displays transaction outcomes. Note that in contrast to the second display section 33, described later, the display section included in the operation and display section 33 is primarily employed in transaction procedures, and may be thought of as a first display section.

The second display section 32 displays additional information to the customer, and primarily functions as an additional display or a separate display from the operation and display section 33 that is used in transaction operations. The placement position of the second display section 32 is not particularly limited, but the second display section 32 is preferably provided at a position that is clearly visible to a customer when the customer is standing in front of the cash processing device 1 to use the cash processing device 1. Note that in the case of the example of FIG. 2, the second display section 32 is illustrated at an upper portion of the cash processing device 1.

The banknote pay-in/pay-out port 11 conveys banknotes inserted by a customer along a conveyance path (not illustrated in the drawings) inside the cash processing device 1 one note at a time, and dispenses banknotes for pay-out via a conveyance path inside the cash processing device 1.

The card insertion/removal port 12 takes inserted cards into the cash processing device 1 and returns cards conveyed from inside the cash processing device 1.

The passbook insertion/removal port 13 takes inserted passbooks into the cash processing device 1 and returns passbooks conveyed from inside the cash processing device 1.

Figure 3:
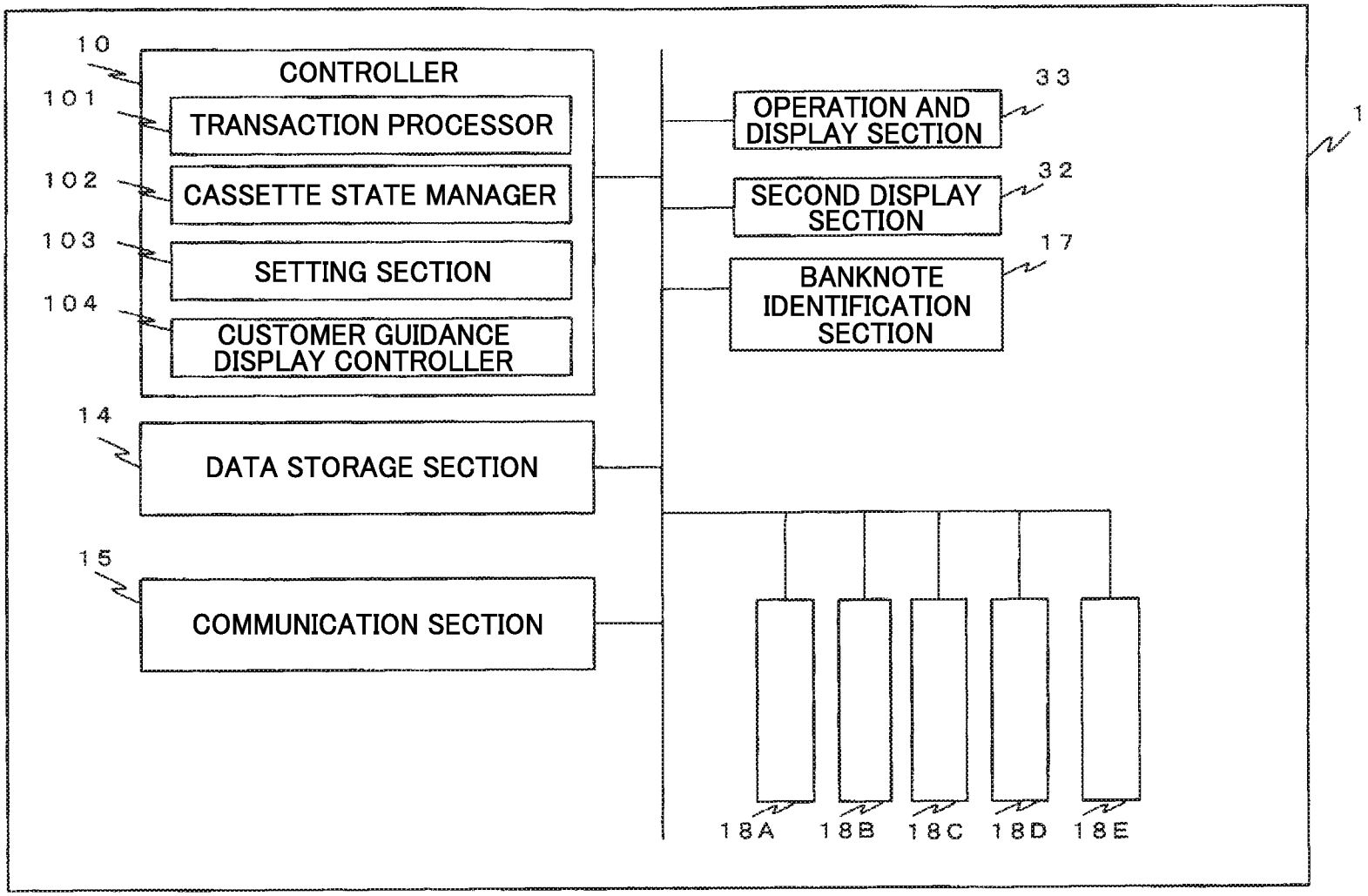
FIG. 3 is a configuration diagram illustrating configuration of a cash processing device control system according to the first exemplary embodiment.

FIG. 3 is a configuration diagram illustrating configuration of a control system for the cash processing devices 1 according to the first exemplary embodiment.

The cash processing device 1 illustrated in FIG. 3 includes a controller 10, a data storage section 14, a communication section 15, a banknote identification section 17, the operation and display section 33, the second display section 32, and plural (five in FIG. 3) banknote cassettes 18A to 18E.

The banknote cassettes 18A to 18E are mounted to the cash processing device 1 as units in a lower section, and store banknotes by denomination. In a pay-in transaction, the denomination of a banknote inserted through the banknote pay-in/pay-out port 11 is identified by the banknote identification section 17, and the banknote is then stacked in the banknote cassette 18 of the corresponding denomination. In a pay-out transaction, a banknote fed out from the banknote cassette 18 of the corresponding denomination is dispensed through the banknote pay-in/pay-out port 11. Each banknote cassette 18 may, for example, be designated pay-in only or pay-out only, or may be compatible with both pay-in and pay-out by using paid-in banknotes as pay-out banknotes (namely, a recirculating-type recycling cassette). The explanation of the present exemplary embodiment envisages banknote cassettes that are compatible with both pay-in and pay-out.

The banknote identification section 17 is mounted inside the cash processing device 1, and identifies the denomination of pay-in or pay-out banknotes, tallies banknote numbers, and determines the state of banknotes (for example dirty, torn, or genuine/counterfeit). The controller 10 is notified of the determination results of the banknote identification section 17.

The controller 10 oversees various functions capable of being implemented by the cash processing device 1. For example, the controller 10 controls various transaction processing of the cash processing device 1, manages banknote storage statuses (namely, the numbers of stored notes) of the banknote cassettes 18, displays available transaction types according to the storage status of the banknote cassettes 18, and guides customers to use another cash processing device when necessary.

A CPU of the controller 20 implements the various functions of the cash processing device 1 ATM 1 by, for example, executing a processing program stored in ROM. The various functions may be achieved by installing the processing program, in which case the processing program may be illustrated as a functional block in the example of FIG. 3.

As illustrated in FIG. 3, the controller 10 includes a transaction processor 101, a cassette state manager 102, a setting section 103, and a customer guidance display controller 104.

The transaction processor 101 performs various transaction processing such as pay-in transactions and pay-out transactions of the cash processing device 1. The transaction processor 101 performs transaction processing of a type instructed via the operation and display section 33 of the cash processing device 1.

The cassette state manager 102 manages storage statuses relating to storage inside each of the banknote cassettes 18 (18A, 18B, 18C, 18D, 18E).

The cassette state manager 102 identifies information regarding the denomination of banknotes stored in each of the banknote cassettes 18 in advance, and manages the number of stored banknotes in each banknote cassette per banknote cassette 18. For example, the cassette state manager 102 may manage the storage status of the banknote cassettes 18 based on sensor information obtained by a cassette-full sensor, a cassette-nearly-full sensor, a cassette-empty sensor, and a cassette-nearly-empty sensor provided in each of the each of the banknote cassettes 18. Alternatively, for example, the storage status of the banknote cassettes 18 may be managed by remembering the number of stored banknotes in the respective banknote cassettes 18 when a power source is switched ON, and then adding or subtracting the number of paid-in banknotes and the number of paid-out banknotes as counted by the banknote identification section 17 in subsequent transaction processing. Note that for example "full" describes a state in which a banknote cassette is filled to capacity with stored banknotes, and no further banknotes can be stored. "Nearly-full" describes a state that is not yet filled to capacity but is close to being filled to capacity. Empty describes a state in which there are no banknotes whatsoever in a banknote cassette, and nearly-empty describes a state in which although some notes are present, the banknote cassette is close to becoming empty.

The setting section 103 sets various setting information relating to customer guidance display processing by the customer guidance display controller 104, described later. The setting section 103 sets various setting information relating to customer guidance display control. More specifically, the setting section 103 can set setting information including comparison thresholds (referred to hereafter as customer guidance thresholds) for the number of stored notes in each of the banknote cassettes 18, this relating to customer guidance display control.

Note that the customer guidance thresholds are set respectively for pay-in transactions and pay-out transactions, and are thresholds used to suppress execution of transactions. The customer guidance threshold is a value relating to a number of stored notes set for each banknote unit 18 and is a threshold for execution of display control to prompt a customer to use another cash processing device 1 in order to avoid an employee having to recover cash or load cash.

Namely, when any of the banknote cassettes 18 reaches a full state or an empty state, an employee is called out to recover the cash from, or load cash into, the cash processing device 1 in question. However, the banknote cassettes 18 of other cash processing devices 1 in the same branch GP1 or GP2 might not be in the full state or empty state. Therefore, in order to even out usage of all of the cash processing devices 1 in the branch and thus reduce the frequency of secure courier callouts to the branch, the customer guidance thresholds for initiating customer guidance to prompt customers to use another cash processing device 1 are set for each banknote cassette 18.

The customer guidance thresholds preferably include, for example, a value close to but smaller than a nearly-full value used to detect a nearly-full state of a banknote cassette 18, and a value close to but greater than a nearly-empty value used to detect a nearly-empty state of a banknote cassette 18.

The customer guidance thresholds are not thresholds for detecting a near state (nearly-full state) or the empty state (nearly-empty state) and disabling pay-in transactions or pay-out transactions. Instead, the customer guidance thresholds are thresholds set with the aim of guiding customers to use another cash processing device 1 in the branch. Namely, the cash processing device 1 in question does have the ability to perform pay-in transactions or pay-out transactions. The customer guidance thresholds are provided in order to reduce the frequency of secure courier callouts by initiating customer guidance display to guide customers to use another cash processing device 1 in the same branch. In the cash processing device 1, even if a recirculating-type recycling banknote cassette 18 temporarily stores more banknotes than a customer guidance threshold, these banknotes might be paid out from the banknote cassette 18 in a subsequent pay-out transaction, thereby reducing the number of stored notes in the banknote cassette 18 in question. In such cases, the cash processing device 1 is, of course, capable of pay-out transactions, and the cash processing device 1 also becomes capable of pay-in transactions when the number of stored notes in the banknote cassette 18 has decreased. Operating in this manner enables the usage of the cash processing devices 1 in the branch to be evened out, and enables the frequency of employee callouts to be reduced.

From perspectives such as the above, the values of the customer guidance thresholds are preferably set to a smaller value than the nearly-full value at which the nearly-full state of the banknote cassette 18 is detected, and a larger value than the nearly-empty value at which the nearly-empty state is detected.

Common values may be employed as the customer guidance thresholds for each of the plural cash processing devices 1 in a branch, or different values may be employed for each cash processing device 1. Moreover, common values may be employed as the customer guidance thresholds of each of the plural banknote cassettes 18, or different values may be employed for each banknote cassette 18. This is since the maximum number of stored notes of a banknote cassette 1 may differ depending on model of the cash processing device 1. Setting may therefore be made possible according to the model of the cash processing device 1 and the like.

Moreover, the values of the customer guidance thresholds may be settable to plural values for a single banknote cassette 18. For example, plural thresholds, such as a first threshold and a second threshold, may be provided as customer guidance thresholds, with a different customer guidance display screen being displayed each time the number of stored notes in a banknote cassette 18 reaches one of the thresholds.

The customer guidance display controller 104 compares the number of stored notes in each banknote cassette 18 managed by the cassette state manager 102 against the customer guidance thresholds, and performs customer guidance display screen display control prompting customers to use another cash processing device 1 in response to the comparison results.

Detailed explanation regarding the processing of the customer guidance display controller 104 will be given in the "Operation" section, but the customer guidance display controller 104 may display a customer guidance display screen on the second display section 32, may display a customer guidance display screen on the operation and display section 33, or may display customer guidance display screens on both the second display section 32 and the operation and display section 33.

By prompting customers to use another cash processing device 1 in this manner, the usage across all of the cash processing devices 1 installed in a branch can be evened out. Moreover, since an employee of a secure courier company is called out when one cash processing device 1 has reached a full state or an empty state, reducing the number of times a cash processing device 1 is used when it becomes close to the full state or the empty state, while increasing the usage of other cash processing devices 1, enables the frequency of employee callouts to be reduced.

The data storage section 14 stores, for example, the processing program executed by the controller 10, information relating to banknote storage in each of the banknote cassettes 18, setting information relating to customer guidance display control, transaction information, and information acquired during transactions.

Note that the information relating to banknote storage in the banknote cassettes 18 includes, for example, setting information relating to the denomination of banknotes stored in each banknote cassette 18, the number of stored notes in each banknote cassette 18, and status information of each banknote cassette 18 (for example a full state, nearly-full state, empty state, nearly-empty state, or customer guidance state). The setting information relating to the customer guidance display control is information including the customer guidance thresholds and screen information relating to the customer guidance display.

The communication section 15 exchanges information with the server 2.

Figure 4:
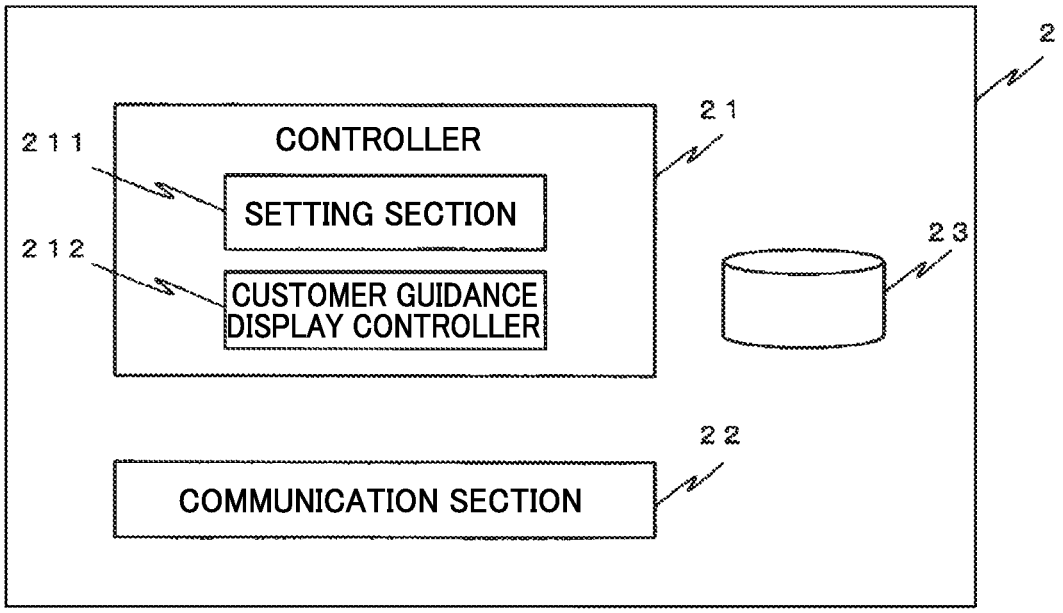
FIG. 4 is an internal configuration diagram illustrating an internal configuration of a server according to the first exemplary embodiment.

FIG. 4 is an internal configuration diagram illustrating internal configuration of the server 2 according to the first exemplary embodiment.

The server 2 according to the first exemplary embodiment illustrated in FIG. 4 includes a controller 21, a communication section 22, and a storage section 23.

The server 2 is provided with a hardware configuration similar to that of existing server-computers. The server 2 acquires various information from each cash processing device 1 installed in the branches GP1, GP2, and manages the status of each cash processing device 1 in the branches GP1, GP2.

The server 2 acquires information relating to the storage status of each banknote cassette 18 from each cash processing device 1 in the branches GP1, GP2, and, according to the storage status of the banknote cassettes 18 of each cash processing device 1, controls display of customer guidance display screens that prompt customers to use another cash processing device 1 in the branch.

The controller 21 includes a setting section 211 and a customer guidance display controller 212. The setting section 211 and the customer guidance display controller 212 are functional sections that are basically the same as, or correspond to, the setting section 103 and the customer guidance display controller 104 of the controller 10 of each cash processing device 1.

The controller 21 is capable of controlling display screens displayed on the operation and display section 33 and the second display section 32 of each cash processing device 1, and the third display section 31.

Accordingly, the controller 21 issues display commands to the respective cash processing devices 1 and is capable of displaying customer guidance display screens on the second display section 32 and displaying customer guidance display screens on the operation and display section 33. The controller 21 is also capable of displaying customer guidance display screens on the third display section 31 provided in the area where the cash processing devices 1 are installed in the branches GP1, GP2.

The storage section 23 stores, for example, a processing program executed by the controller 21, information relating to banknote storage in the banknote cassettes 18 of each cash processing device 1 in the branches GP1, GP2, setting information relating to customer guidance display control, transaction information, and information acquired during transactions.

The information relating to banknote storage by the banknote cassettes 18 includes, for example, setting information relating to the denomination of banknotes stored in each banknote cassette 18, the number of stored notes in each banknote cassette 18, and status information of each banknote cassette 18 (for example, full state, nearly-full state, empty state, nearly-empty state, or customer guidance state) for each cash processing device 1 in each branch. The setting information relating to customer guidance display control is information including the customer guidance thresholds and screen information relating to the customer guidance display.

The communication section 22 exchanges information with each cash processing device 1 and with the third display section 31 in each branch.

(A-2) First Exemplary Embodiment: Operation

Next, detailed explanation follows regarding operation of the customer guidance display processing according to the first exemplary embodiment, with reference to the drawings.

Figure 5:
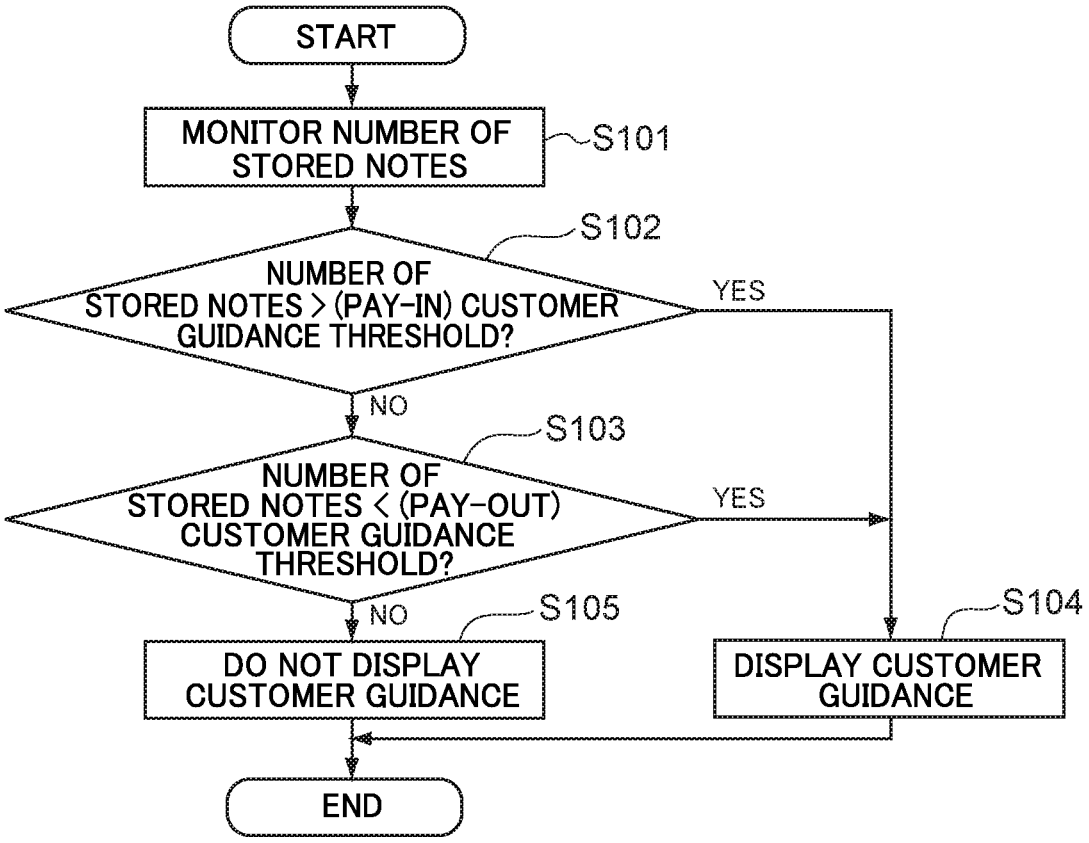
FIG. 5 is a flowchart illustrating operation during customer guidance display processing according to the first exemplary embodiment.

FIG. 5 is a flowchart illustrating operation during customer guidance display processing according to the first exemplary embodiment.

Customer guidance display screens can be displayed on any or all out of the third display section 31 in each branch, the second display section 32 of each cash processing device 1, and the operation and display section 31 of each cash processing device 1. Moreover, configuration may be made such that commands relating to customer guidance display screen display can be issued by either the controllers 10 of the respective cash processing devices 1 or by the controller 21 of the server 2.

For ease of explanation, the following explanation describes a case in which the controllers 10 of the cash processing devices 1 display customer guidance display screens on the second display section 32.

In FIG. 5, the setting section 104 in the controller 10 of the cash processing device 1 sets the customer guidance thresholds for each banknote cassette 18. Here, the respective customer guidance thresholds are set to a smaller value than the nearly-full value at which the number of stored notes in the banknote cassette 18 is detected to be becoming large (a pay-in customer guidance threshold), and to a larger value than the nearly-empty value at which the number of stored notes in the banknote cassette 18 is detected to be becoming small (a pay-out customer guidance threshold).

The controller 10 of the cash processing device 1 monitors each banknote cassette 18 for the number of stored notes per banknote cassette 18 (S101).

In the cash processing device 1, the customer guidance display controller 104 compares the number of stored notes in each banknote cassette 18 against the (pay-in) customer guidance threshold (S102).

For example, the customer guidance display controller 104 performs the processing from S102 onward at a point when transition is first made to a transaction screen, such as on startup, and at a point when each transaction ends. Alternatively, for example, the customer guidance display controller 104 may also perform the processing from S102 onwards either at a point when transition is first made to a transaction screen or at a point when each transaction ends. Namely, the storage status of the banknote cassettes 18 changes when a transaction, such as a previous transaction or a current transaction, is completed. Accordingly, the number of stored notes in each banknote cassette 18 is compared against the customer guidance thresholds each time a transaction is completed. The customer guidance display controller 104 compares the number of stored notes against the (pay-in) customer guidance threshold for each of the plural banknote cassettes 18A to 18E.

In cases in which the number of stored notes in any of the banknote cassettes 18 exceeds the customer guidance threshold, the customer guidance display controller 104 displays a customer guidance display screen on the second display section 32 and on the operation and display section 33 (S104).

Moreover, in the cash processing device 1, the customer guidance display controller 104 compares the number of stored notes in each banknote cassette 18 against the (pay-out) customer guidance threshold (S103). When this is performed, the customer guidance display controller 104 compares the number of stored notes against the (pay-out) customer guidance threshold for each of the plural banknote cassettes 18A to 18E.

In cases in which the number of stored notes in any of the banknote cassettes 18 is below the (pay-out) customer guidance threshold, the customer guidance display controller 104 displays a customer guidance display screen on the second display section 32 and the operation and display section 33 (S104).

In cases in which the number of stored notes in any of the banknote cassettes 18 does not exceed the (pay-in) customer guidance threshold and is not below the (pay-out) customer guidance threshold, the customer guidance display controller 104 does not display a customer guidance display screen (S105).

Figure 6:
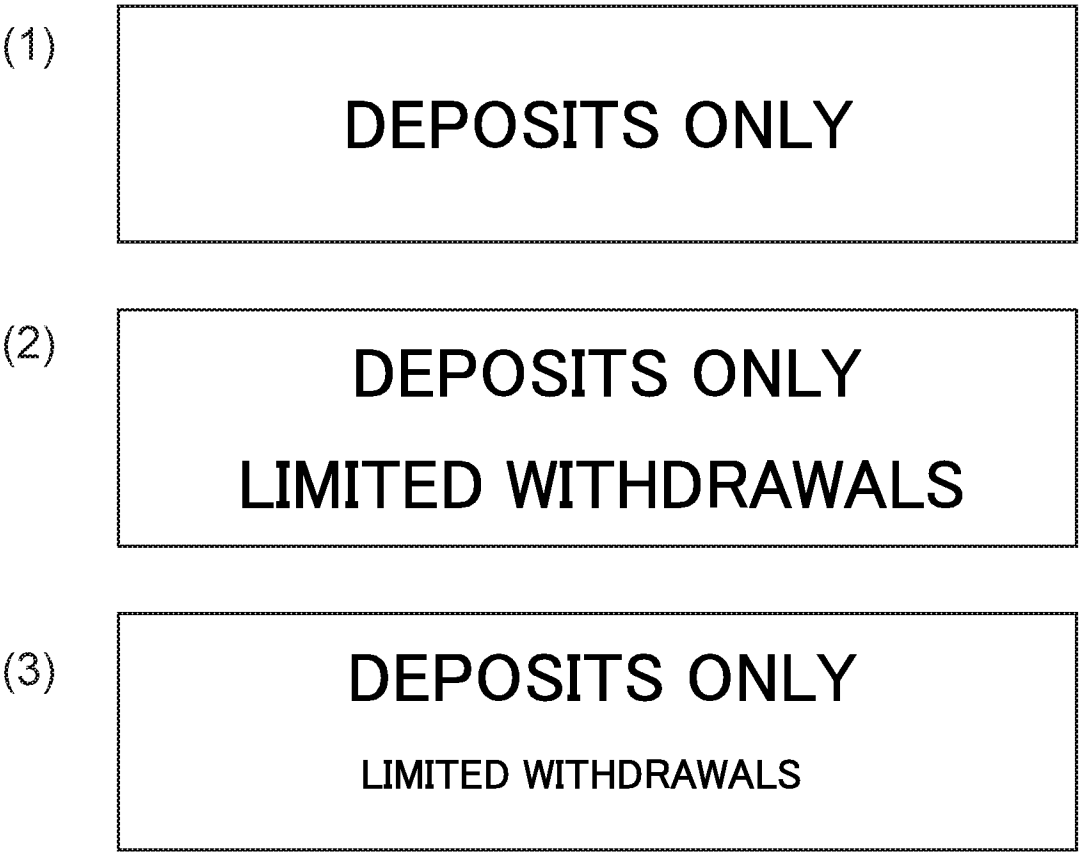
FIG. 6 is an explanatory diagram to explain display methods for customer guidance display screens according to the first exemplary embodiment.

FIG. 6 is an explanatory diagram to explain a display method of a customer guidance display screen according to the first exemplary embodiment.

An example is illustrated for a case in which the number of stored notes in a banknote cassette 18 is below the pay-out customer guidance threshold.

As illustrated in FIG. 6 (1), in cases in which the number of stored notes in a banknote cassette 18 is below the pay-out customer guidance threshold, the customer guidance display controller 104 may display a message screen such as "Deposits only" on the second display section 32. Informing customers with this "Deposits only" message enables customers wishing to perform a pay-out transaction to be guided to another cash processing device 1.

As illustrated in FIG. 6 (2), in cases in which the number of stored notes in a banknote cassette 18 is below the pay-out customer guidance threshold, the customer guidance display controller 104 may display a message screen such as "Deposits only. Limited withdrawals" on the second display section 32. Informing customers with this "Limited withdrawals" message clarifies the transaction type that is being suppressed, and enables customers to be guided to another cash processing device 1.

As illustrated in FIG. 6 (3), in cases in which the number of stored notes in a banknote cassette 18 is below the pay-out customer guidance threshold, the customer guidance display controller 104 displays a screen with a message such as "Deposits only" in large text, and displays a message such as "Limited withdrawals" in smaller text on the second display section 32. Here, since this cash processing device 1 does have the ability to perform pay-out transactions, the suppressed transaction type ("pay-out transactions") on the cash processing device 1 is displayed smaller so as to provide guidance to the customer.

In the examples of FIG. 6 (1) to FIG. 6 (3), when the number of stored notes in a banknote cassette 18 has reached the customer guidance threshold, customers are guided so as to use another cash processing device 1 to perform the transaction type for which the customer guidance threshold has been reached.

Namely, although the number of stored notes has reached a customer guidance threshold in the cash processing device 1, since neither the empty state nor the full state have been reached, the cash processing device 1 is in a state capable of performing pay-out transactions or pay-in transactions. However, the cash processing device 1 is in a state in which the number of stored notes in a banknote cassette 18 has become low or a state in which the number of stored notes in a banknote cassette 18 has become high.

Accordingly, were the cash processing device 1 to continue to perform pay-out transactions or pay-in transactions in this state, the nearly-empty state or the empty state might be reached. The cash processing device 1 therefore informs customers that only pay-in transactions or pay-out transactions are available. This thereby enables customers wishing to perform a pay-in transaction or a pay-out transaction respectively to be guided to another cash processing device 1.

Note that in cases in which a banknote cassette 18 includes recirculating-type recycling functionality, if pay-in transactions are performed after the pay-out customer guidance threshold has been reached, such that the number of stored notes in the banknote cassette 18 increases, display of the customer guidance display screen is ended, and pay-out transactions once again become available.

Similarly, in cases in which a banknote cassette 18 includes recirculating-type recycling functionality, if pay-out transactions are performed after the pay-in customer guidance threshold has been reached, such that the number of stored notes in the banknote cassette 18 decreases, display of the customer guidance display screen is ended, and pay-in transactions once again become available.

Note that in the examples described above, the customer guidance display screen is displayed on the second display section 32. However, the customer guidance display screen may be displayed on the operation and display section 33. In such cases, for example, a customer guidance display screen such as those illustrated in FIG. 6 (1) to FIG. 6 (3) may be displayed as a pop-up screen on a pre-transaction display screen such as a transaction menu screen so as to efficiently guide a customer to another cash processing device 1 before commencing a transaction.

FIG. 12 and FIG. 13 are explanatory diagrams to explain customer guidance display screens displayed on the third display section 31 according to the first exemplary embodiment.

The customer guidance display screen illustrated in FIG. 12 displays a table indicating whether or not pay-in transactions and pay-out transactions are available or limited on each cash processing device 1.

The customer guidance display screen illustrated in the example of FIG. 13 displays a circle when pay-in transactions or pay-out transactions are available, and displays a triangle when pay-in transactions or pay-out transactions are limited. Note that as described above, since even when the number of stored notes in a cash processing device 1 has reached a customer guidance threshold, pay-in transactions or pay-out transactions are still technically possible, and limited transactions are therefore indicated by a triangle rather than by an X.

(A-3) First Exemplary Embodiment: Advantageous Effects

As described above, when the number of stored notes in a banknote cassette has reached a customer guidance threshold, a customer guidance display screen is displayed, thereby enabling customers to be guided to use another cash processing device. The usage of all of the plural cash processing devices in a branch is evened out as a result, enabling a reduction in the frequency of callouts to a secure courier to collect cash or load cash.

(B) Second Exemplary Embodiment

Next, detailed explanation follows regarding a second exemplary embodiment of a cash processing device and server according to the present invention, with reference to the drawings.

The second exemplary embodiment also describes an example in which the present invention is applied to cash processing devices, such as ATMs provided in a financial institution or the like, and a server that monitors the cash processing devices.

(B-1) Second Exemplary Embodiment: Configuration and Operation

A cash processing system, cash processing device, and server according to the second exemplary embodiment include the configuration elements illustrated in FIG. 1 to FIG. 5 for the first exemplary embodiment. Accordingly, the second exemplary embodiment is also described with reference to FIG. 1 to FIG. 5.

A feature of the second exemplary embodiment lies in the point that customers are guided according to the storage status of all of the plural cash processing devices 1 installed in a branch.

Figure 7:
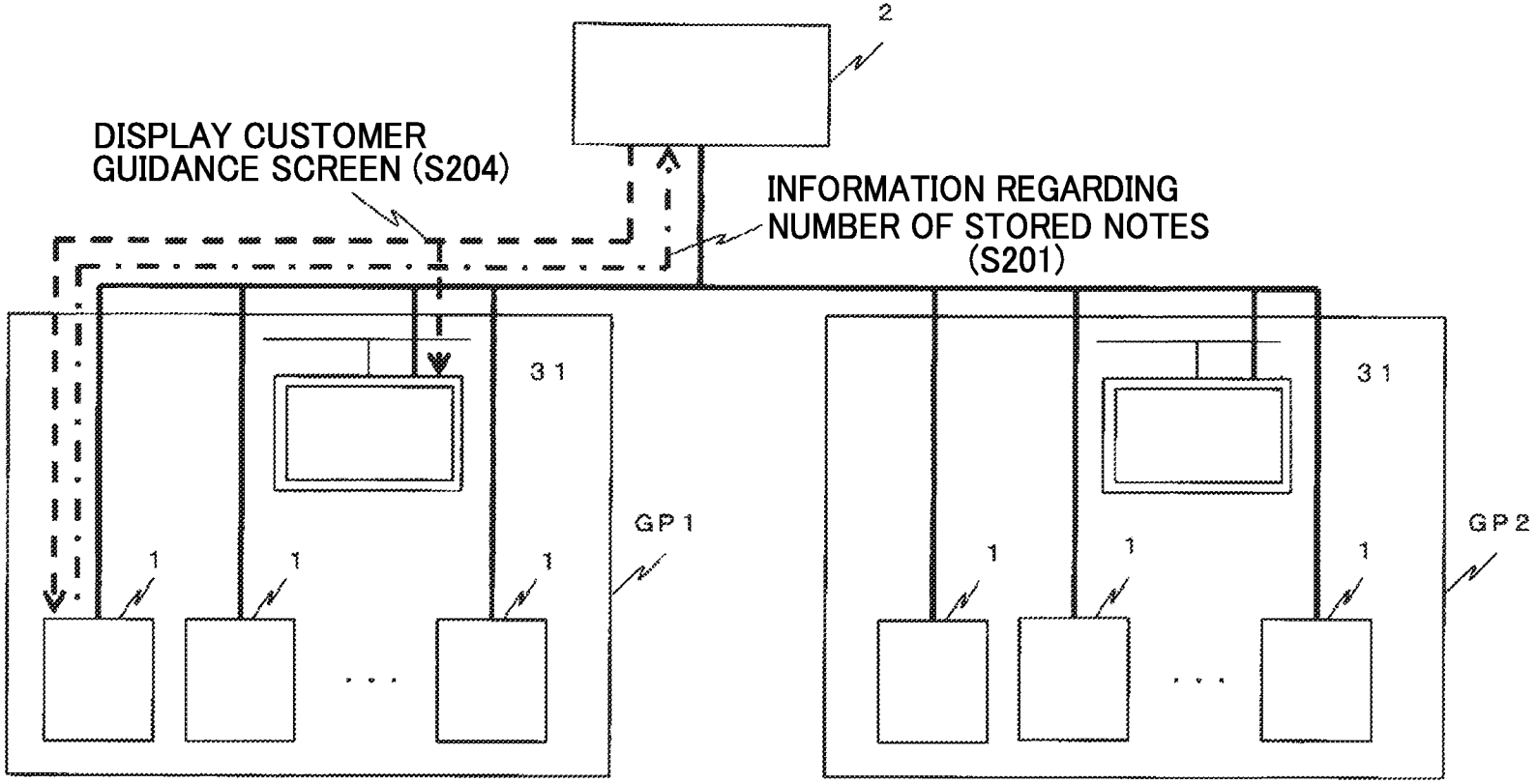
FIG. 7 is an explanatory diagram to explain overall operation during customer guidance display processing according to a second exemplary embodiment.

FIG. 7 is an explanatory diagram to explain overall operation of customer guidance display processing according to the second exemplary embodiment.

Figure 8:
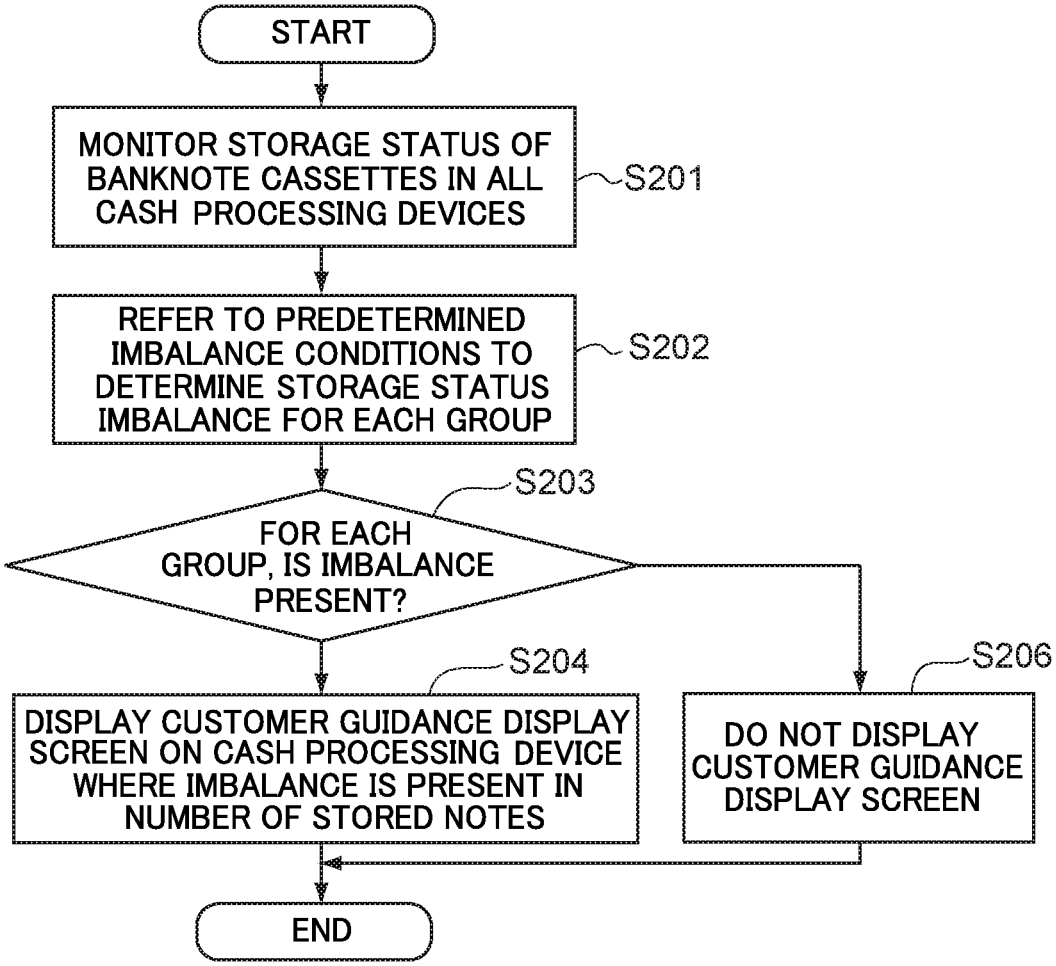
FIG. 8 is a flowchart illustrating operation during customer guidance display processing in a server according to the second exemplary embodiment.

FIG. 8 is a flowchart illustrating operation during customer guidance display processing in a server 2 according to the second exemplary embodiment.

First, the server 2 constantly monitors storage information for each banknote cassette 18 of every cash processing device 1. For example, the server 2 transmits request signals inquiring about the number of stored notes in each banknote cassette 18 to each cash processing device 1 that is performing a transaction. The cash processing devices 1 respond to the inquiry from the server 2 with the number of stored notes in each banknote cassette 18. In this manner, the server 2 acquires the number of stored notes in each banknote cassette 18 from all of the cash processing devices 1 (S201).

Note that in the example illustrated in FIG. 9, the server 2 manages the storage status of the cash processing devices 1 in groups.

In FIG. 9, the numbers such as "01" are identification numbers of the cash processing devices 1. "Normal" and "(Pay-in) customer guidance threshold exceeded" represent the storage status of each cash processing device 1. For example, "(Pay-in) customer guidance threshold exceeded" indicates that the number of stored notes in the cash processing device 1 "01" has exceeded the (pay-in) customer guidance threshold, while "normal" indicates that the cash processing device 1 is in operation. Note that the storage status may also be managed using statuses such as "nearly-full", "full", "nearly-empty", and "empty".

Moreover, in FIG. 9, "display to suppress pay-in" and "do not display", for example, indicate whether or not a customer guidance display screen is being displayed on the display sections (the second display section 32, the operation and display section 33, and the like) of a cash processing device 1. For example, "display to suppress pay-in" indicates that a customer guidance display screen to suppress pay-in is being displayed.

Next, based on the storage status of every cash processing device 1 in a group and by referencing predetermined imbalance conditions, the customer guidance display controller 202 in the server 2 determines, for each group, whether or not any imbalance is present in the numbers of stored notes (S202).

Note that each group is a group in which customers can be guided to another cash processing device 1 when the number of stored notes has reached a customer guidance threshold in one particular cash processing device 1. Each group, for example, corresponds to a branch of a financial institution.

The imbalance conditions are conditions used to determine whether or not any imbalance is present in the number of stored notes between all of the cash processing devices 1 belonging to the same group.

Figure 10:
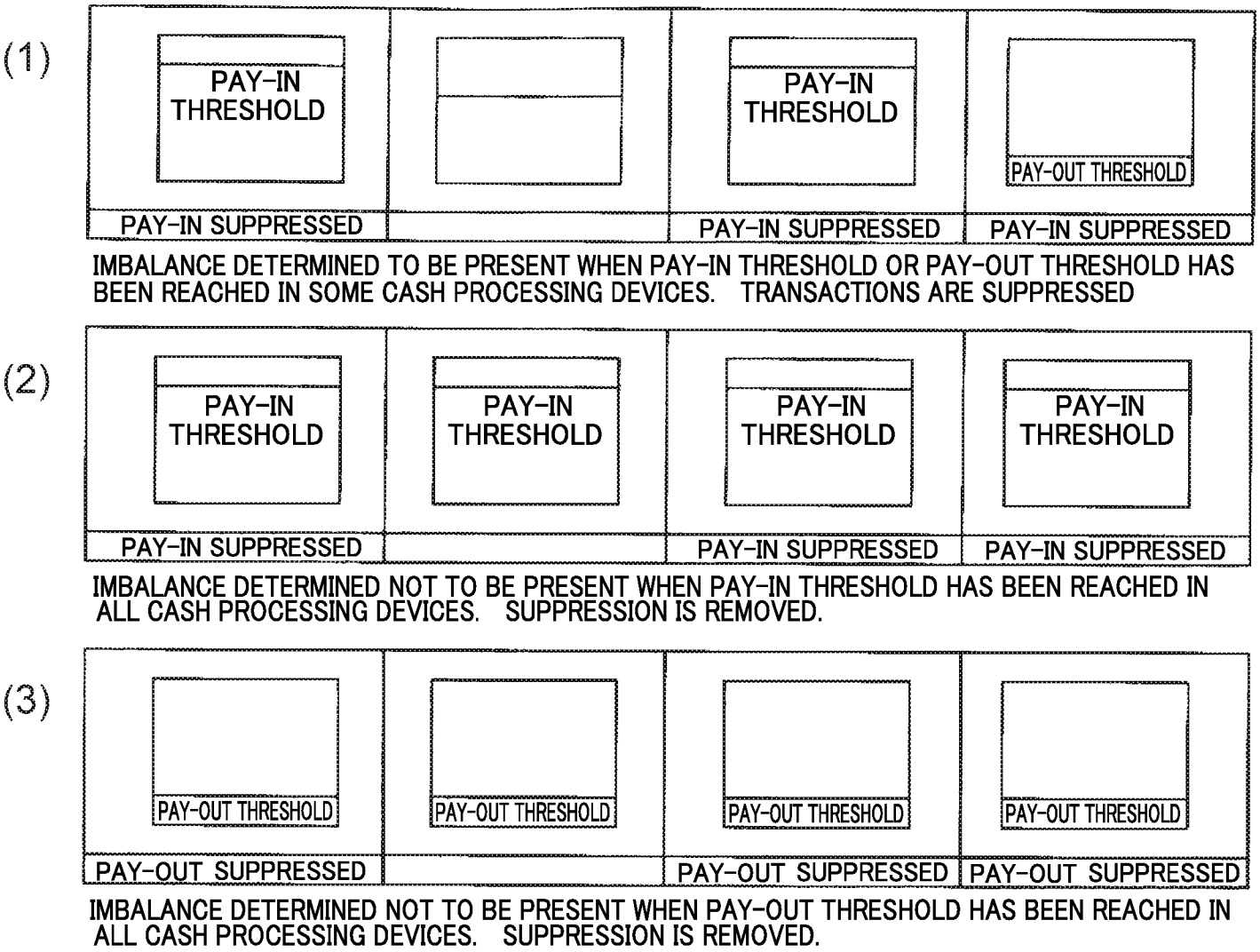
FIG. 10 is an explanatory diagram to explain imbalance conditions according to the second exemplary embodiment.
Figure 11:
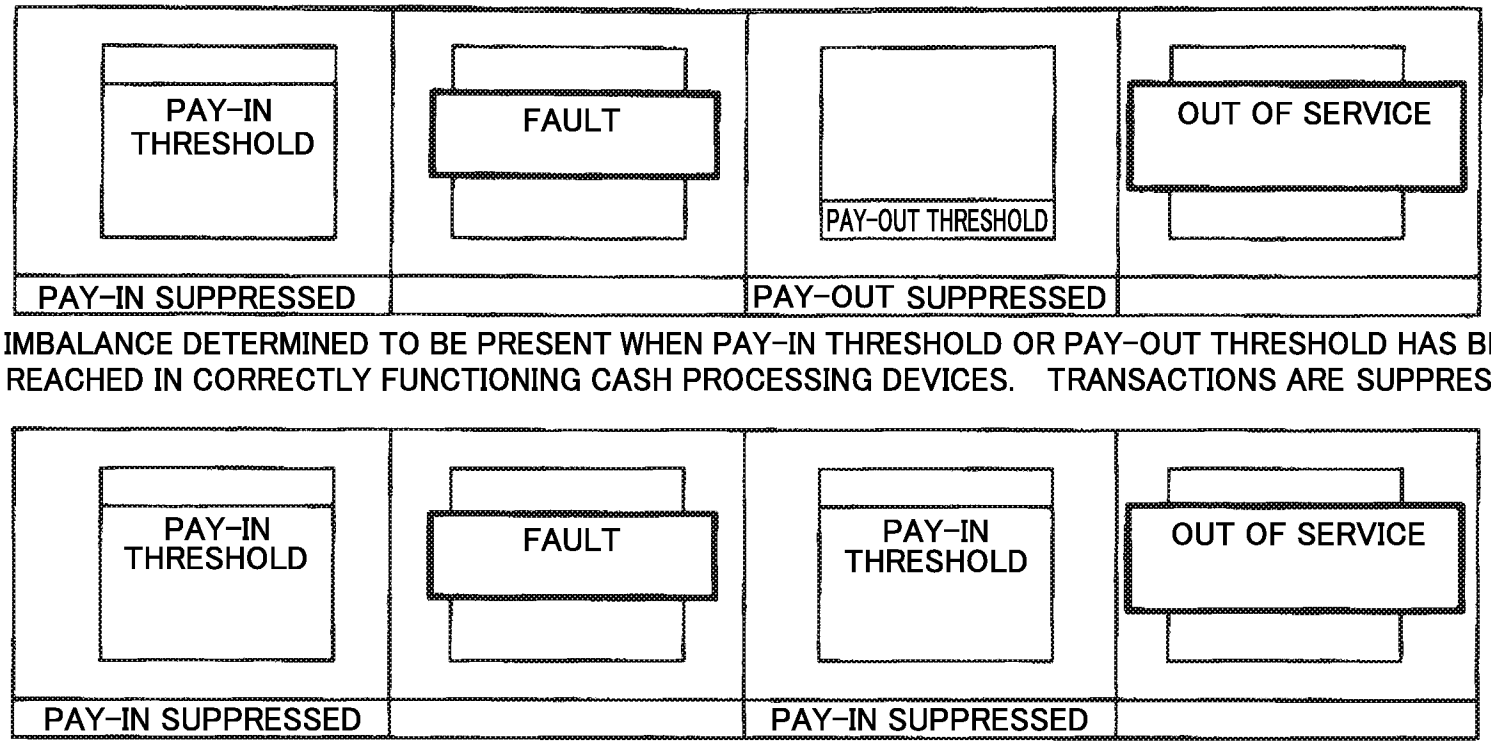
FIG. 11 is an explanatory diagram to explain imbalance conditions according to the second exemplary embodiment.

FIG. 10 and FIG. 11 are explanatory diagrams to explain imbalance conditions according to the second exemplary embodiment. FIG. 10 and FIG. 11 illustrate examples in which one group is formed of four cash processing devices 1.

FIG. 10 (1) illustrates a case in which in one group, the number of stored notes in two cash processing devices 1 has reached the pay-in customer guidance threshold (indicated by "pay-in threshold" in FIG. 10), and the number of stored notes in one cash processing device 1 has reached the pay-out customer guidance threshold (indicated by "pay-out threshold" in FIG. 10). When some of the cash processing devices 1 have reached either the pay-in or pay-out customer guidance threshold in this manner, a customer guidance display controller 202 determines that "imbalance is present" (S203). The cash processing devices 1 in which the imbalance is present (in which the number of stored notes has reached a customer guidance threshold) display customer guidance display screens (S204).

FIG. 10 (2) illustrates a case in which in one group, the number of stored notes in three cash processing devices 1 has reached the pay-in customer guidance threshold ("pay-in threshold"). FIG. 10 (3) illustrates a case in which in one group, the number of stored notes in three cash processing devices 1 has reached the pay-out customer guidance threshold ("pay-out threshold").

When, as in FIG. 10 (2) and FIG. 10 (3), all of one subset of cash processing devices 1 have reached either the pay-in or pay-out customer guidance threshold, the customer guidance display controller 202 determines that "imbalance is not present" (S203), and the customer guidance display screens are not displayed (S205).

In this manner, in cases in which statuses of the numbers of stored notes are the same for plural cash processing devices 1 in one group, a customer guidance display screen is not displayed, and cash is collected or cash is loaded when the number of stored notes in any one of the cash processing devices 1 has reached the full state or the empty state. Note that when an employee is called out to one group (one branch) in order to collect cash or load cash, cash can be collected from, or cash can be loaded into, plural of the cash processing devices 1 at the same time, enabling cash to be collected and cash to be loaded efficiently.

In FIG. 11 (1) and FIG. 11 (2), out of the four cash processing devices 1, one of the cash processing devices 1 is suffering from a fault, and one of the other cash processing devices 1 is not in service (Out Of Service).

In such cases, the customer guidance display controller 202 makes determination (S203) that imbalance is present when the cash processing devices that are operating correctly each have different states (namely, there is a mixture of cash processing devices in which the number of stored notes has reached the pay-in threshold and cash processing devices in which the number of stored notes has reached the pay-out threshold). The customer guidance display controller 202 then displays customer guidance display screens (S204).

The customer guidance display controller 202 makes determination (S203) that imbalance is present when cash processing devices operating correctly each have the same state (namely, the number of stored notes in all of the cash processing devices 1 has reached either the pay-in threshold or the pay-out threshold). The customer guidance display controller 202 then does not display a customer guidance display screen (S205).

Note that similarly to in the first exemplary embodiment, the customer guidance display screens displayed on the second display section 32 and the operation and display section 33 of the cash processing devices 1 by the server 2 are the screens illustrated in the examples of FIG. 6 (1) to FIG. 6 (3).

(B-2) Second Exemplary Embodiment: Advantageous Effects

As described above, in the second exemplary embodiment, in addition to similar advantageous effects to those of the first exemplary embodiment, customer guidance display screens can be displayed according to the storage status of plural cash processing devices belonging to a group.

(C) Third Exemplary Embodiment

Next, detailed explanation follows regarding a third exemplary embodiment of a cash processing device and a server according to the present invention, with reference to the drawings.

The third exemplary embodiment also describes an example in which the present invention is applied to cash processing devices, such as ATMs provided in a financial institution or the like, and a server that monitors the cash processing devices.

(C-1) Third Exemplary Embodiment: Configuration

Figure 14:
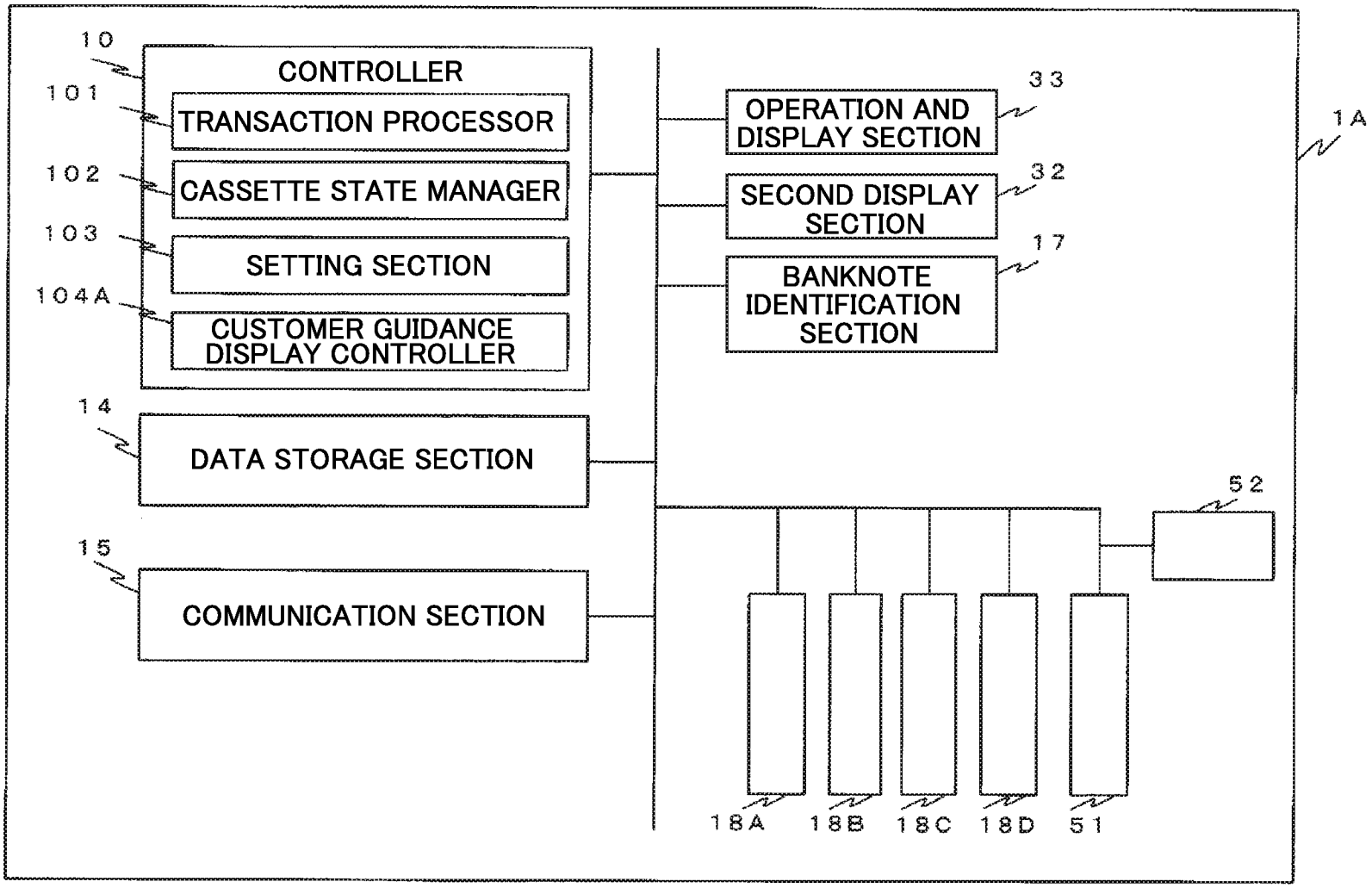
FIG. 14 is a configuration diagram illustrating configuration of a cash processing device control system according to a third exemplary embodiment.

FIG. 14 is a configuration diagram illustrating configuration of a control system of a cash processing device 1A according to the third exemplary embodiment.

A cash processing device 1A according to the third exemplary embodiment illustrated in FIG. 14 includes a controller 10, a data storage section 14, a communication section 15, a banknote identification section 17, an operation and display section 33, a second display section 32, plural (four in FIG. 14) banknote cassettes 18A to 18D, a pay-in only banknote cassette 51, and a reject box 52.

As illustrated in FIG. 14, the cash processing device 1A includes the pay-in only banknote cassette 51 and the reject box 52 in addition to the recirculating-type recycling cassettes configuring the banknote cassettes 18A to 18D.

Explanation follows regarding examples of usage methods of the pay-in only banknote cassette 51 and the reject box 52.

The pay-in only banknote cassette 51 only stacks banknotes, and is a banknote cassette that does not pay out stored banknotes. Namely, the pay-in only banknote cassette 51 has a banknote stacking function, but does not have a function to feed out stored banknotes to pay out banknotes that have been paid in, as in a recirculating-type recycling cassette. Generally speaking, the pay-in only banknote cassette 51 is not denomination-specific in the banknotes it stacks, and is capable of stacking plural banknote denominations.

As one example of a usage method of the pay-in only banknote cassette 51, when the number of stored notes in a recirculating-type recycling cassette increases such that the recirculating-type recycling cassette reaches a full state (or nearly-full state) and can no longer be used, banknotes paid in subsequently are conveyed to and stacked in the pay-in only banknote cassette 51. As another example, in cases in which a paid-in banknote has a denomination that has not been assigned to any of the recirculating-type recycling cassettes, the paid-in banknote is conveyed to and stacked in the pay-in only banknote cassette 51.

This enables, for example, paid-in banknotes to be stacked in the pay-in only banknote cassette 51 even when a recirculating-type recycling cassette has reached the full state or when a denomination that has not been assigned to a recirculating-type recycling cassette is paid in.

Moreover, the reject box 52 holds banknotes that have been rejected based on the results of classification by the banknote identification section 17. For example, paid-in banknotes that are found to be dirty or torn as a result of classification by the banknote identification section 17 and that cannot be paid out are held in the reject box 52 (depending on the operation, dirty or torn banknotes and the like are sometimes stacked in the pay-in use banknote cassette 51). As another example, when a banknote is determined to be counterfeit in authenticity determination by the banknote identification section 17, the banknote determined to be counterfeit is returned to the customer, but if the banknote was paid out from a recirculating-type recycling cassette, the banknote is held in the reject box 52.

Sections that stack banknotes but are not used to pay out stored banknotes, such as the pay-in only banknote cassette 51 or the reject box 52 described above, are referred to herein as "non-pay-out banknote storage sections".

Note that FIG. 14 illustrates an example in which the cash processing device 1A is provided with one each of the pay-in only banknote cassette 51 and the reject box 52.

However, the cash processing device 1A may be provided with only the pay-in only banknote cassette 51, or may be provided with only the reject box 52. Namely, configuration may be made in which the cash processing device 1A includes only one non-pay-out storage section.

Moreover, the cash processing device 1A may include plural of the pay-in only banknote cassettes 51, and may include plural of the reject boxes 52. Namely, the cash processing device 1A may include plural non-pay-out storage sections of each type of non-pay-out storage section having different functions and serving different purposes.

The processing of a customer guidance display controller 104A of the cash processing device 1A illustrated in FIG. 14 differs from that of the first exemplary embodiment. Detailed explanation is thus given regarding the processing of the customer guidance display controller 104A in the third exemplary embodiment. Note that the processing of other configuration elements is similar to that of the first exemplary embodiment, and detailed explanation thereof is therefore omitted.

The customer guidance display controller 104A is managed by the cassette state manager 102. Display control of customer guidance display screens prompting customers to use another cash processing device 1 is performed according to the storage status of each of the banknote cassettes 18A to 18D, the pay-in only banknote cassette 51, and the reject box 52.

The number of stored notes in the pay-in only banknote cassette 51 and the reject box 52 configuring non-pay-out storage sections is managed by the cassette state manager 102.

Hitherto, when the pay-in only banknote cassette 51 configuring a non-pay-out storage section reached a full state, the cash processing device 1A would become incapable of performing pay-in transactions, and when the number of stored notes in the reject box 52 reached a full state, the cash processing device 1A would become incapable of performing both pay-in transactions and pay-out transactions. An employee of a secure courier company would be called out to collect the cash in such situations.

When the number of stored notes in the banknote cassettes 18A to 18D reaches a customer guidance threshold for pay-in transactions, the cash processing device 1A limits pay-in transactions, but the basic ability to perform pay-in transactions is present.

Moreover, since the banknote cassettes 18A to 18D are recirculating-type recycling cassettes, the cash processing device 1A can perform pay-out transactions. Accordingly, if pay-out transactions are performed, thereby decreasing the number of stored notes in the banknote cassettes 18A to 18D that are in a state close to the full state, the cash processing device 1A is capable of performing pay-in transactions and pay-out transactions without limitations.

However, if the number of stored notes in the pay-in only banknote cassette 51 or the reject box 52 reaches the full state, the cash processing device 1A cannot attain a state capable of performing pay-in transactions or pay-out transactions without an employee of a secure courier company being called out to collect the cash.

Accordingly, in the third exemplary embodiment it is possible to guide customers to use another cash processing device 1A before the number of stored notes in the pay-in only banknote cassette 51 or the reject box 52 reaches the full state.

In this manner, the overall usage of the cash processing devices 1 installed in a branch can be evened out by prompting customers to use another cash processing device 1A. Increasing the usage of other cash processing devices 1A enables the frequency of employee callouts to be reduced.

(C-2) Third Exemplary Embodiment: Operation

Next, detailed explanation follows regarding operation of the customer guidance display processing according to the third exemplary embodiment, with reference to the drawings.

Three examples of operation during customer guidance display processing according to the third exemplary embodiment are described below. However, processing to display a customer guidance display screen according to the storage status of a non-pay-out storage section is not limited to the following three examples of operation.

Note that similarly to in the first exemplary embodiment, customer guidance display screens can be displayed on any or all of the third display section 31 in the branch, the second display section 32 of the cash processing device 1A, or the operation and display section 31 of the cash processing device 1. Moreover, commands relating to display of customer guidance display screens may be issued by any out of the controllers 10 of the respective cash processing devices 1A, or by the controller 21 of the server 2.

For ease of explanation, in the following explanation an example is given in which the controller 10 of the cash processing device 1A displays customer guidance display screens on the second display section 32.

(C-2-1) First Operation Example

Figure 15:
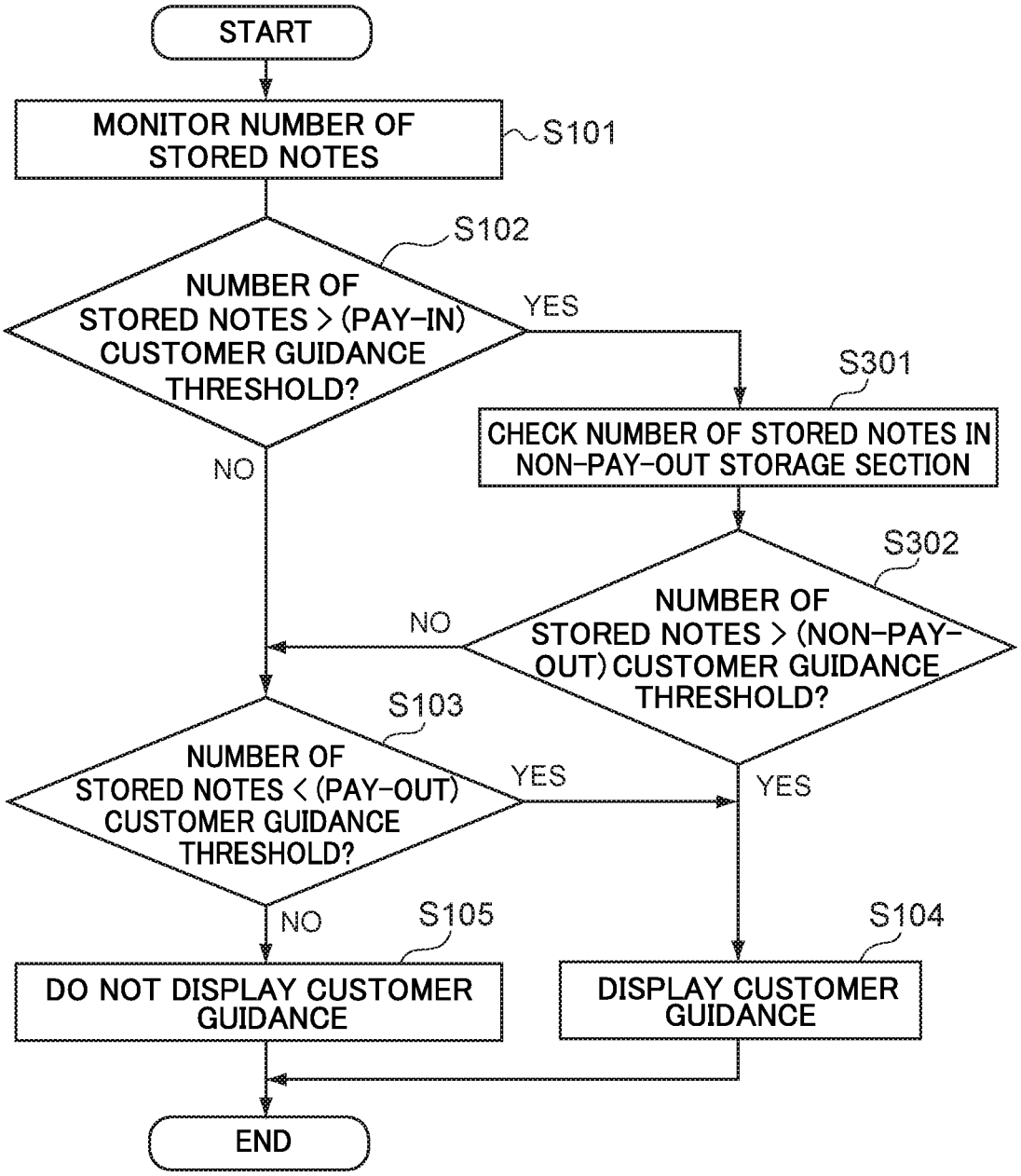
FIG. 15 is a flowchart illustrating operation during customer guidance display processing according to the third exemplary embodiment.

FIG. 15 is a flowchart illustrating operation of the customer guidance display processing according to the third exemplary embodiment.

In FIG. 15, the setting section 104 in the controller 10 of the cash processing device 1 is used to set customer guidance thresholds for each of the banknote cassettes 18A to 18D, as well as for the pay-in only banknote cassette 51 and the reject box 52 configuring non-pay-out storage sections.

Note that in FIG. 15, the customer guidance thresholds for the pay-in only banknote cassette 51 and the reject box 52 are denoted "(non-pay-out) customer guidance threshold".

The number of banknotes present inside a cassette at an execution timing is expressed as a number of stored notes.

The controller 10 of the cash processing device 1 monitors the number of stored notes in the banknote cassettes 18 for each of the banknote cassettes 18 (S101). The customer guidance display controller 104 compares the number of stored notes in each banknote cassette 18 against the (pay-in) customer guidance threshold (S102). Note that the storage status of the banknote cassettes 18 changes when a transaction, such as a previous transaction or a current transaction, is completed. Accordingly, the number of stored notes in the banknote cassettes 18A to 18D is compared against the customer guidance thresholds each time a transaction is completed.

In cases in which the number of stored notes in any of the banknote cassettes 18A to 18D exceeds the customer guidance threshold (S102), the customer guidance display controller 104A checks the number of stored notes in the pay-in only banknote cassette 51 and the reject box 52 (S301).

In cases in which the number of stored notes in either the pay-in only banknote cassette 51 or the reject box 52 exceeds the customer guidance threshold (S302), the customer guidance display controller 104A displays a customer guidance display screen on the second display section 32 and on the operation and display section 33 (S104).

In cases in which the number of stored notes does not exceed the customer guidance thresholds in either the pay-in only banknote cassette 51 or the reject box 52 (S302), processing transitions to S103.

In this manner, in cases in which the number of stored notes in any of the banknote cassettes 18A to 18D configured by recirculating-type recycling cassettes has reached the (pay-in) customer guidance threshold, a customer guidance display screen is displayed if the number of stored notes in either the pay-in only banknote cassette 51 or the reject box 52 exceeds the customer guidance threshold. The cash processing device 1A thus limits pay-in transactions, but pay-out transactions can still be accepted.

There is therefore a possibility that the number of stored notes in the banknote cassettes 18A to 18D might decrease as a result of pay-out transactions, after which pay-in transactions can be performed as normal. Moreover, customers can be guided to use another cash processing device 1A before the number of stored notes in the pay-in only banknote cassette 51 or the reject box 52 reaches the full state.

The processing of S103 to S105 is similar to that of the first exemplary embodiment, and so detailed explanation thereof is omitted herein.

(C-2-2) Second Operation Example

Figure 16:
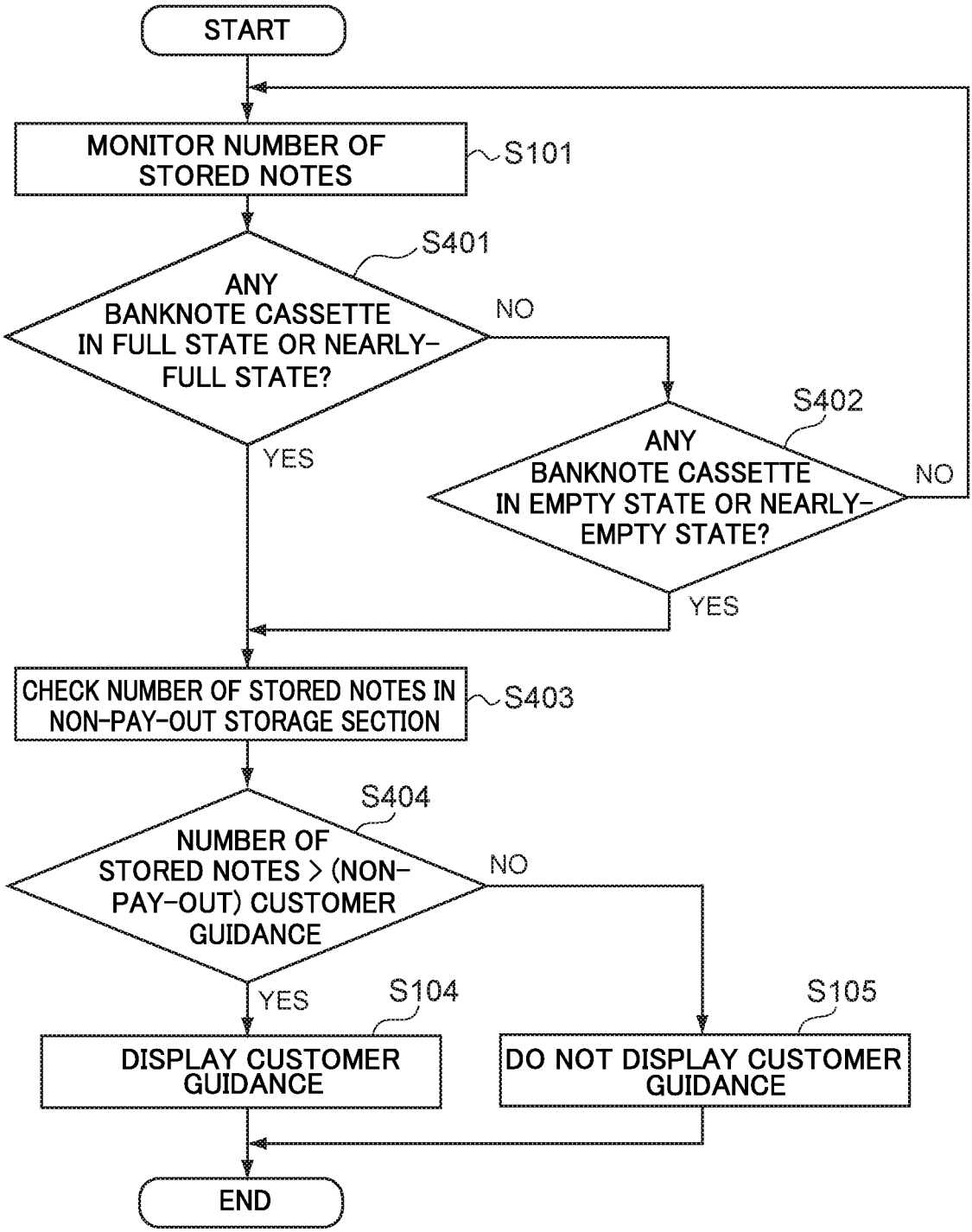
FIG. 16 is a flowchart illustrating operation during customer guidance display processing according to the third exemplary embodiment.

FIG. 16 is a flowchart illustrating operation of customer guidance display processing according to the third exemplary embodiment.

In FIG. 16, the setting section 104 in the controller 10 of the cash processing device 1 is used to set customer guidance thresholds for the banknote cassettes 18A to 18D, as well as for the pay-in only banknote cassette 51 and the reject box 52 configuring non-pay-out storage sections.

The controller 10 of the cash processing device 1 monitors the number of stored notes in the banknote cassettes 18 for each of the banknote cassettes 18 (S101). The customer guidance display controller 104 determines whether or not the storage status of each banknote cassette 18 configured by a recirculating-type recycling cassette is the full state (or the nearly-full state) (S401).

In cases in which none of the banknote cassettes 18 configured by a recirculating-type recycling cassette has a full state (or nearly-full state) as its storage status, the customer guidance display controller 104 determines whether or not the storage status of each banknote cassette 18 configured by a recirculating-type recycling cassette is the empty state (or nearly-empty state) (S402). Note that processing returns to S101 in cases in which none of the banknote cassettes 18 configured by recirculating-type recycling cassettes has a full state (or nearly-full state) or an empty state (or nearly-empty state) as its storage status.

In cases in which the storage status of any of the banknote cassettes 18 configured by a recirculating-type recycling cassette is the full state (or nearly-full state), or in cases in which the storage status of any of the banknote cassettes 18 configured by a recirculating-type recycling cassette is the empty state (or nearly-empty state), the customer guidance display controller 104A checks the number of stored notes in the pay-in only banknote cassette 51 and the reject box 52 (S403).

In cases in which the number of stored notes in either the pay-in only banknote cassette 51 or the reject box 52 exceeds the customer guidance threshold (S404), the customer guidance display controller 104A displays a customer guidance display screen on the second display section 32 and the operation and display section 33 (S104).

On the other hand, in cases in which the number of stored notes does not exceed the customer guidance threshold in either the pay-in only banknote cassette 51 or the reject box 52 (S404), the customer guidance display controller 104A does not display a customer guidance display screen on the second display section 32 or the operation and display section 33 (S105).

In this manner, customers can be guided to use another cash processing device 1A in cases in which any of the banknote cassettes 18A to 18D configured by recirculating-type recycling cassettes is in the full state (or nearly-full state). As a result, customers can thus be guided to use another cash processing device 1A before the number of stored notes in the pay-in only banknote cassette 51 or the reject box 52 reaches the full state.

(C-2-3) Third Operation Example

Figure 17:
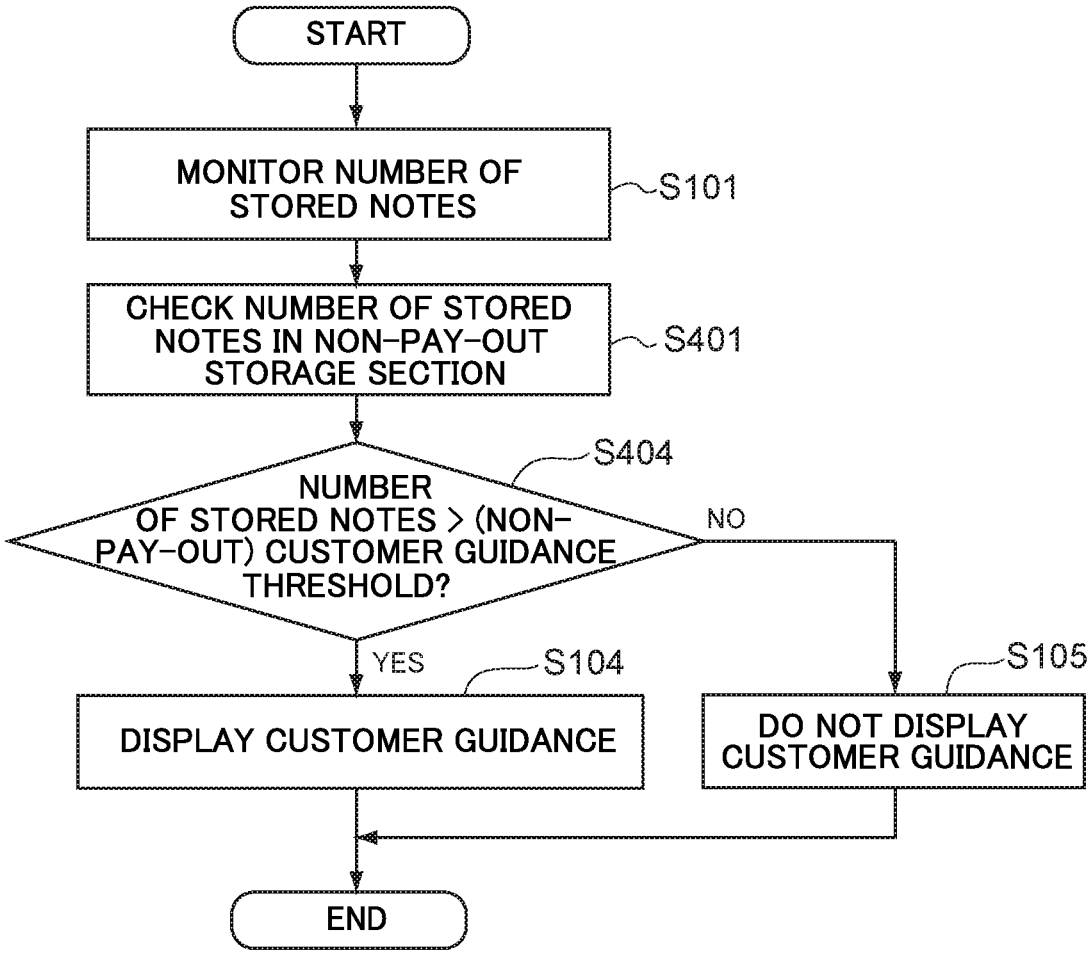
FIG. 17 is a flowchart illustrating operation during customer guidance display processing according to the third exemplary embodiment.

FIG. 17 is a flowchart illustrating operation of the customer guidance display processing according to the third exemplary embodiment.

In FIG. 17, the setting section 104 in the controller 10 of the cash processing device 1 is used to set customer guidance thresholds for each of the banknote cassettes 18A to 18D, as well as for the pay-in only banknote cassette 51 and the reject box 52 configuring non-pay-out storage sections.

The controller 10 of the cash processing device 1 monitors the number of stored notes in the banknote cassettes 18 for each of the banknote cassettes 18 (S101). The customer guidance display controller 104 checks the number of stored notes in the pay-in only banknote cassette 51 and the reject box 52 configuring non-pay-out storage sections (S401).

In cases in which the number of stored notes in either the pay-in only banknote cassette 51 or the reject box 52 exceeds the customer guidance threshold (S404), the customer guidance display controller 104A displays a customer guidance display screen on the second display section 32 and on the operation and display section 33 (S104).

On the other hand, in cases in which the number of stored notes does not exceed the customer guidance threshold in either the pay-in only banknote cassette 51 or the reject box 52 (S404), the customer guidance display controller 104A does not display a customer guidance display screen on the second display section 32 or the operation and display section 33 (S105).

The operation processing illustrated in FIG. 17 enables customers to be guided to use another cash processing device 1A before the number of stored notes in the pay-in only banknote cassette 51 or the reject box 52 reaches the full state, even when not in a state in which the number of stored notes in any of the banknote cassettes 18A to 18D configured by recirculating-type recycling cassettes has reached the full state (or nearly-full state) or reached a customer guidance threshold.

(C-3) Third Exemplary Embodiment: Advantageous Effects

As described above, in addition to similar advantageous effects to those to first exemplary embodiment, the third exemplary embodiment is also capable of guiding customers to use another cash processing device 1A before the number of stored notes in the pay-in only banknote cassette 51 or the reject box 52 reaches the full state.

(D) Other Exemplary Embodiments

Although various modified exemplary embodiments have already been mentioned with respect to the first exemplary embodiment to the third exemplary embodiment described above, the following modified exemplary embodiments may also be applied in the present invention.

(D-1) The first to third exemplary embodiments above describe examples in which a customer guidance display screen is displayed when the storage status of any one out of plural banknote cassettes provided to a cash processing device exceeds a customer guidance threshold.

However, the controller 10 of each cash processing device 1 and the controller 21 of the server 2 also manage the storage status of each banknote cassette of the cash processing devices 1. Accordingly, configuration may be made so as to display customer guidance display screens suppressing transactions by denomination. For example, "¥10,000 note deposit transactions (or withdrawal transactions) limited" may be displayed when, from out of the plural banknote cassettes, only the number of stored notes in a banknote cassette for ¥10,000 notes has reached the customer guidance threshold.

(D-2) In the first to the third exemplary embodiments described above, the setting section 103 or a setting section 201 may be set manually by a technician from the financial institution or the like.

Moreover, the setting section 103 or the setting section 201 may be set with customer guidance thresholds using values derived from statistical data or analytic data based on data for past fluctuations in the number of stored notes in the respective banknote cassettes of the cash processing device 1. More specifically, for example, the usage frequency of the cash processing device 1 may fluctuate between weekdays and weekends/holidays. Accordingly, values may be set in consideration of usage frequency based on time-related factors.

(D-3) The third exemplary embodiment above describes an example in which the storage status of the pay-in only banknote cassette 51 and the reject box 52 configuring non-pay-out storage sections are determined by the customer guidance display controller. However, the pay-in only banknote cassette 51 and the reject box 52 configuring non-pay-out storage sections may be provided with sensors to detect the storage statuses thereof. The customer guidance display controller may check the number of stored notes in the non-pay-out storage sections by receiving notification from the sensors, and make determination by comparing this against customer guidance display thresholds.

The disclosure of Japanese Patent Application No. 2015-243296, filed on Dec. 14, 2015, is incorporated in its entirety by reference herein.

The invention claimed is:

1. A cash processing device comprising:

a storage section that stores banknotes, and that feeds out the stored banknotes:

a non-pay-out storage section that only stores banknotes of a plurality of denominations;

a manager that manages a storage status in the storage section and the non-pay-out storage section, the storage status including a number of stored banknotes in the storage section and a number of stored banknotes in the non-pay-out storage section or a proportion of the storage section occupied by stored banknotes and a proportion of the non-pay-out storage section occupied by stored banknotes; and a controller that, according to the storage status in the storage section and the non-pay-out storage section, causes display of a display screen on a display section to suppress a specific transaction of a type selected from a plurality of transaction types, to encourage a transaction other than the specific transaction of the type selected from the plurality of transaction types, or a combination thereof, wherein the controller causes display of the display screen on the display section when the number of stored banknotes in the storage section or the proportion of the storage section occupied by stored banknotes has reached a full state or has reached a first threshold for suppressing the specific transaction, and the number of stored banknotes in the non-pay-out storage section or the proportion of the non-pay-out storage section occupied by stored banknotes has reached a second threshold for suppressing the specific transaction, and the display screen is displayed before a user can commence a transaction.

2. The cash processing device of claim 1, wherein the controller compares the number of stored banknotes in the storage section or the proportion of the storage section occupied by stored banknotes against the first threshold, and causes display of the display screen when the number of stored banknotes in the storage section or the proportion of the storage section occupied by stored banknotes has reached the first threshold.

3. The cash processing device of claim 1, wherein:

the display section includes:

a first display section that is a main display section and is employed in customer operations, and a second display section that is distinct from the first display section; and the controller causes display of the display screen on either the first display section or the second display section, or on both the first display section and the second display section.

4. The cash processing device of claim 1, wherein:

the storage section includes a first storage section and a second storage section, and the controller compares the number of stored banknotes in the first storage section or the proportion of the first storage section occupied by stored banknotes against the first threshold and the number of stored banknotes in the second storage section or the proportion of the second storage section occupied by stored banknotes against a third threshold, and causes display of the display screen when the number of stored banknotes in the first storage section or the proportion of the first storage section occupied by stored banknotes has reached the first threshold or the number of stored banknotes in the second storage section or the proportion of the second storage section occupied by stored banknotes has reached the third threshold.

5. The cash processing device of claim 1, wherein the first threshold is the same value as the second threshold.

6. A cash processing device comprising:

a first storage section that stores banknotes of a first denomination, which are to be used in both of a pay-out transaction and a pay-in transaction;

a second storage section that stores banknotes of a second denomination, which are to be used in both of a pay-out transaction and a pay-in transaction;

a manager that manages a storage status in the first storage section and the second storage section, the storage status including a number of stored banknotes in the first storage section and a number of stored banknotes in the second storage section or a proportion of the first storage section occupied by stored banknotes and a proportion of the second storage section occupied by stored banknotes; and a controller that, according to the storage status in the first storage section and the second storage section, causes display of a display screen on a display section to suppress a pay-out transaction from a plurality of transaction types, wherein when the number of banknotes stored in the first storage section or the proportion of the first storage section occupied by the stored banknotes is below a first threshold, the controller causes display of a display screen on the display section that, for a pay-out transaction, the pay-out is suppressed, and for a pay-in transaction, the pay-in transaction is encouraged.

* * * * *